US008114564B2

(12) United States Patent
Kamiyoshi et al.

(10) Patent No.: US 8,114,564 B2
(45) Date of Patent: Feb. 14, 2012

(54) PROCESS FOR PRODUCING TONER FOR ELECTROPHOTOGRAPHY

(75) Inventors: Nobumichi Kamiyoshi, Wakayama (JP); Manabu Suzuki, Wakayama (JP); Yutaka Murai, Wakayama (JP)

(73) Assignee: KAO Corporation, Tokyo (JP)

( * ) Notice: Subject to any disclaimer, the term of this patent is extended or adjusted under 35 U.S.C. 154(b) by 508 days.

(21) Appl. No.: 11/942,351

(22) Filed: Nov. 19, 2007

(65) Prior Publication Data

US 2008/0131804 A1 Jun. 5, 2008

(30) Foreign Application Priority Data

Dec. 5, 2006 (JP) ..... 2006-328173

(51) Int. Cl.
*G03G 9/08* (2006.01)

(52) U.S. Cl. ..... 430/137.14; 430/137.11

(58) Field of Classification Search ..... 430/110.2, 430/137.14, 137.11
See application file for complete search history.

(56) References Cited

U.S. PATENT DOCUMENTS

| | | | | |
|---|---|---|---|---|
| 5,215,854 | A * | 6/1993 | Yamazaki et al. | 430/137.11 |
| 5,308,734 | A * | 5/1994 | Sacripante et al. | 430/137.14 |
| 7,179,576 | B2 * | 2/2007 | Ueda et al. | 430/137.11 |
| 2005/0074685 | A1 * | 4/2005 | Kido et al. | 430/110.2 |

FOREIGN PATENT DOCUMENTS

| | | |
|---|---|---|
| JP | 10-293419 | 11/1998 |
| JP | 2000-267348 | 9/2000 |
| JP | 2000-347449 | 12/2000 |
| JP | 2002-82490 | 3/2002 |
| JP | 2002-357929 | 12/2002 |

OTHER PUBLICATIONS

English language translation of JP 01-185649 (1989).*
Office Action issued Mar. 22, 2011 in Chinese Patent Application No. 200710166792.X (with English translation).

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

The present invention relates to a process for producing a toner for electrophotography which includes the steps of (A) forming resin-containing core particles having a volume median particle size (D50) of from 1 to 10 μm in an aqueous medium; (B) adding composite fine particles containing a polyester-containing resin and a charge control agent, or composite fine particles containing "fine particles of the charge control agent" and "fine particles of the polyester-containing resin", to the core particles obtained in the step (A) to allow the composite fine particles to adhere onto the core particles, thereby obtaining "composite fine particle-adhering core particles"; and (C) heating the "composite fine particle-adhering core particles" obtained in the step (B), to obtain coalesced particles. There are provided a process for producing a toner for electrophotography having a small particle size and a narrow particle size distribution which is capable of allowing a charge control agent to exist on a surface of the toner; and a toner for electrophotography which is produced by the process and can exhibit excellent image-forming characteristics.

17 Claims, No Drawings

PROCESS FOR PRODUCING TONER FOR ELECTROPHOTOGRAPHY

FIELD OF THE INVENTION

The present invention relates to a toner for electrophotography for use in electrophotographic method, an electrostatic recording method, an electrostatic printing method or the like, and a process for producing the toner.

BACKGROUND OF THE INVENTION

In the field of toners for electrophotography, with the progress of electrophotographic systems, it has been demanded to develop toners adaptable for high image quality and high copying speed. From the viewpoint of the high image quality, the toners have been required to have a small particle size. Thus, there has been proposed a so-called chemical toner obtained by a chemical method such as a polymerization method and an emulsification and dispersion method in place of the conventional melt-kneading and pulverizing method. The chemical toner has been noticed from the viewpoints of a small particle size and a narrow particle size distribution thereof.

The toner obtained by the melt-kneading and pulverizing method is readily electrically charged owing to its irregular shape having concave and convex portions. However, the toner obtained by the chemical method have substantially no charge-generating portions by itself owing to a spherical shape thereof. Therefore, it is required to allow a charge control agent to exist on a surface of the toner.

Thus, as such a toner on the surface of which a charge control agent is present, there is disclosed a toner obtained by mixing a dispersion of resin particles enclosing a charge control agent with emulsified particles having an average particle size of about 8 μm and then drying the resultant mixture (JP 10-293419A).

Also, as the toner containing core particles produced by an emulsification aggregating method onto which a charge control agent adheres, there are disclosed a toner obtained by forming aggregated particles in a dispersion containing resin particles, producing coalesced particles therefrom, and then adding styrene-acryl resin particles enclosing a charge control agent to the coalesced particles (JP 2002-82490A); a toner obtained by adding a charge control agent during a period between initiation and termination of a step of forming aggregated particles in a dispersion containing resin particles (JP 2000-347449A); and a toner obtained by forming aggregated particles in a dispersion containing resin particles, allowing particles of a charge control agent and a styrene-acryl resin to adhere onto the aggregated particles, and heating the resultant particles to produce coalesced particles (JP 2000-267348A).

In addition, there has been reported a toner obtained by mixing toner mother particles (core particles) and a charge control agent with each other (JP 2002-357929A).

SUMMARY OF THE INVENTION

Thus, the present invention relates to:

(1) A process for producing a toner for electrophotography, including the steps of:

(A) forming resin-containing core particles having a volume median particle size (D50) of from 1 to 10 μm in an aqueous medium;

(B) adding composite fine particles containing a polyester-containing resin and a charge control agent, or composite fine particles containing "fine particles of the charge control agent" and "fine particles of the polyester-containing resin", to the core particles obtained in the step (A), to allow the composite fine particles to adhere onto the core particles, thereby obtaining "composite fine particle-adhering core particles"; and (C) heating the "composite fine particle-adhering core particles" obtained in the step (B), to obtain coalesced particles;

(2) a process for producing a toner for electrophotography, including the steps of:

(A) forming resin-containing core particles having a volume median particle size (D50) of from 1 to 10 μm in an aqueous medium;

(B) adding a dispersion of composite fine particles containing a polyester-containing resin and a charge control agent, or a dispersion of composite fine particles containing "fine particles of the charge control agent" and "fine particles of the polyester-containing resin", to a dispersion of the core particles obtained in the step (A), to obtain a dispersion of "composite fine particle-adhering core particles"; and (C) heating the dispersion of the "composite fine particle-adhering core particles" obtained in the step (B), to obtain coalesced particles;

(3) a process for producing a toner for electrophotography, including the steps of:

(A) aggregating resin particles contained in a dispersion to obtain aggregated particles as core particles;

(B) adding composite fine particles containing a polyester-containing resin and a charge control agent, or composite fine particles containing "fine particles of the polyester-containing resin" and "fine particles of the charge control agent", to the aggregated particles as core particles obtained in the step (A), to allow the composite fine particles to adhere onto the aggregated particles, thereby obtaining "composite fine particle-adhering core particles"; and (C) heating the "composite fine particle-adhering core particles" obtained in the step (B), to obtain coalesced particles;

(4) the process described in any one of the above aspects (1) to (3), wherein the composite fine particles are obtained by a process including (1) a step of dispersing the charge control agent in an aqueous medium to prepare a dispersion and (2) a step of mixing and emulsifying the dispersion of "fine particles of the charge control agent" obtained in the step (1) and the polyester-containing resin in an aqueous medium; and (5) a toner for electrophotography produced by the process as described in any one of the above aspects (1) to (4).

DETAILED DESCRIPTION OF THE INVENTION

Although there is the recent tendency toward a high image quality and a high copying speed in electrophotographic systems, the above conventional toners are still unsatisfactory in charging property. The present invention relates to a process for producing a toner for electrophotography which is capable of allowing a charge control agent to exist on the surface of the toner and obtaining a toner having a small particle and a narrow particle size distribution; and a toner for electrophotography capable of exhibiting excellent image-forming characteristics which can be obtained by the process.

In the followings, the process for producing the toner for electrophotography according to the present invention is described.

The present invention relates to a process for producing a toner for electrophotography which includes the steps of (A) forming resin-containing core particles having a volume median particle size ($D_{50}$) of from 1 to 10 μm in an aqueous medium; (B) adding composite fine particles containing a polyester-containing resin and a charge control agent, or composite fine particles containing "fine particles of the charge control agent" and "fine particles of the polyester-containing resin" (i.e. fine particles composed of resin containing polyester), to the core particles obtained in the step (A), to allow the composite fine particles to adhere onto the core particles, thereby obtaining "composite fine particle-adhering core particles"; and (C) heating the "composite fine particle-adhering core particles" obtained in the step (B), to obtain coalesced particles. In addition, the present invention relates to a process for producing a toner for electrophotography which includes the steps of (A) forming resin-containing core particles having a volume median particle size ($D_{50}$) of from 1 to 10 μm in an aqueous medium; (B) adding a dispersion of composite fine particles containing a polyester-containing resin and a charge control agent, or a dispersion of composite fine particles containing "fine particles of the charge control agent" and "fine particles of the polyester-containing resin", to a dispersion of the core particles obtained in the step (A), to obtain a dispersion of "composite fine particle-adhering core particles"; and (C) heating the dispersion of the "composite fine particle-adhering core particles" obtained in the step (B), to obtain coalesced particles. Further, the present invention relates to a process for producing a toner for electrophotography which includes the steps of (A) aggregating resin particles contained in a dispersion to obtain aggregated particles as core particles; (B) adding composite fine particles containing a polyester-containing resin and a charge control agent, or composite fine particles containing "fine particles of the polyester-containing resin" and "fine particles of the charge control agent", to the aggregated particles as core particles obtained in the step (A), to allow the composite fine particles to adhere onto the aggregated particles, thereby obtaining "composite fine particle-adhering core particles"; and (C) heating the "composite fine particle-adhering core particles" obtained in the step (B), to obtain coalesced particles.

[Step (A)]

In the step (A), resin-containing core particles having a volume median particle size ($D_{50}$) of from 1 to 10 μm are formed in an aqueous medium. More specifically, in the step (A), the resin-containing core particles are produced in the form of a dispersion thereof. As the method of obtaining the dispersion of the core particles, there may be used, for example, various methods such as a method of suspending a composition containing the core particles and a resin dissolved in a solvent, in a water, and then distilling off the solvent from the resultant suspension to obtain core particles; an emulsion polymerization aggregating method of adding other materials such as colorants to resin particles obtained by emulsion polymerization and then aggregating the emulsified particles with each other and coalescing to obtain desired resin particles; an emulsification aggregating method of adding other materials such as colorants to resin particles obtained by emulsifying a binder resin in the presence of a surfactant and the like, and then aggregating the resin particles with each other and coalescing to obtain core particles; and a polymerization method of directly producing core particles by a suspension polymerization method. In the present invention, among these methods, the emulsification aggregating method is preferably used in view of reduction in particle size of the toner. The emulsification aggregating method is explained below.

In the emulsification aggregating method, in the step (A), resin particles dispersed in a dispersion containing the resin particles are aggregated together to obtain aggregated particles as core particles. In this step, first, the resin particles are produced in an aqueous medium.

Resins Forming Resin Particles

The resin forming the resin particles preferably contains a polyester from the viewpoints of a good fixing property and a good durability of the toner. The content of the polyester in the resin is preferably 60% by weight or larger, more preferably 70% by weight or larger, even more preferably 80% by weight or larger and further even more preferably substantially 100% by weight from the viewpoints of a good fixing property and a good durability of the resultant toner.

Examples of resins other than the polyester which may be contained in the resin forming the resin particles include known resins conventionally used for toners such as styrene-acryl copolymers, epoxy resins, polycarbonates and polyurethanes.

The raw monomers of the polyester are not particularly limited, and there may be used a known alcohol component and a known carboxylic acid component such as a carboxylic acid, a carboxylic acid anhydride and a carboxylic acid ester.

Specific examples of the alcohol component include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane, ethylene glycol, propylene glycol, glycerol, pentaerythritol, trimethylol propane, hydrogenated bisphenol A, sorbitol, and alkylene ($C_2$ to $C_4$) oxide adducts (average molar number of addition: 1 to 16) of these compounds.

These alcohol components may be used alone or in combination of any two or more thereof.

Examples of the carboxylic acid component include dicarboxylic acids such as phthalic acid, isophthalic acid, terephthalic acid, fumaric acid, maleic acid, adipic acid and succinic acid; succinic acids substituted with an alkyl group having 1 to 20 carbon atoms or an alkenyl group having 2 to 20 carbon atoms such as dodecenylsuccinic acid and octenylsuccinic acid; tri- or higher-valent polycarboxylic acids such as trimellitic acid and pyromellitic acid; and anhydrides of these acids and alkyl ($C_1$ to $C_3$) esters thereof.

These carboxylic acid components may be used alone or in combination of any two or more thereof.

The polyester may be produced, for example, by polycondensing the alcohol component and the carboxylic acid component in an inert gas atmosphere at a temperature of about 180 to 250° C., if required, by using an esterification catalyst.

Examples of the esterification catalyst include tin compounds such as dibutyl tin oxide and tin dioctylate, and titanium compounds such as titanium diisopropylate bistriethanol aminate. The amount of the esterification catalyst used is preferably from 0.01 to 1 part by weight and more preferably from 0.1 to 0.6 part by weight on the basis of 100 parts by weight of a sum of the alcohol components and the carboxylic acid components.

From the viewpoint of a good storage property of the resultant toner, the polyester preferably has a softening point of 70 to 165° C. and a glass transition temperature of 50 to 85° C. The acid value of the polyester is preferably from 6 to 35 mg KOH/g, more preferably from 10 to 35 mg KOH/g and even more preferably from 15 to 35 mg KOH/g from the viewpoint of facilitated production of the emulsion. The softening point or the acid value of the polyester may be desirably adjusted by controlling the ratio between the alcohols and carboxylic acids charged, the temperature and time used in the polycondensation reaction.

From the viewpoint of a good durability of the resultant toner, the number-average molecular weight of the polyester is preferably from 1,000 to 10,000 and more preferably from 2,000 to 8,000.

Meanwhile, in the present invention, as the polyester, there may be used not only unmodified polyesters but also modified polyesters obtained by modifying polyesters to such an extent that the polyesters are substantially free from deterioration in inherent properties thereof. Examples of the modified polyesters include polyesters grafted or blocked with phenol, urethane, epoxy, etc., by the methods described, for example, in JP 11-133668A, JP 10-239903A and JP 8-20636A, and composite resins containing two or more kinds of resin units including a polyester unit.

Meanwhile, when the resin forming the resin particles is composed of a plurality of resins, the softening point, glass transition point, acid value and number-average molecular weight of the resin all mean those values of a mixture of these resins. The respective characteristic values of the mixture are preferably the same as the corresponding values of the polyesters.

Further, from the viewpoints of a good fixing property and a good durability of the toner, the above resin may contain two kinds of polyesters which are different in softening point from each other in which one polyester (a) preferably has a softening point of not lower than 70° C. but lower than 115° C., and the other polyester (b) preferably has a softening point of from 115 to 165° C. The weight ratio of the polyester (a) to the polyester (b) (a/b) in the resin is preferably from 10/90 to 90/10 and more preferably from 50/50 to 90/10.

Aqueous Medium

The aqueous medium used for dispersing the resin contains water as a main component. From the viewpoint of a good environmental suitability, the water content in the aqueous medium is preferably 80% by weight or more, more preferably 90% by weight or more and most preferably 100% by weight.

Examples of components other than water which can be contained in the aqueous medium include water-soluble organic solvents such as methanol, ethanol, isopropanol, butanol, acetone, methyl ethyl ketone and tetrahydrofuran. Among these organic solvents, from the viewpoint of less inclusion into the toner, preferred are alcohol-based organic solvents incapable of dissolving resins therein such as methanol, ethanol, isopropanol and butanol. In the present invention, the resin is preferably dispersed in water solely without using substantially organic solvent to form fine particles thereof.

Production of Dispersion Containing Resin Particles

In the present invention, the dispersion of the resin particles containing the above resin is produced in the aqueous medium. The dispersion containing the resin particles is preferably produced by emulsifying the resin in the aqueous medium from the viewpoints of obtaining the resin particles having a small particle size and achieving a narrow particle size distribution of the obtained toner.

The dispersion of the resin particles obtained by emulsifying the resin in the aqueous medium may contain, in addition to the above resin, various optional additives such as a colorant, a releasing agent and a charge control agent, if required. In particular, when a metal salt as the charge control agent is contained in the dispersion of the resin particles, the resultant toner can ensure a broad fixing temperature range owing to crosslinked structure of the resin and the metal.

Examples of the charge control agent include metal salts of benzoic acid, metal salts of salicylic acid, metal salts of alkylsalicylic acids, metal salts of catechol, metal-containing bisazo dyes, tetraphenyl borate derivatives, quaternary ammonium salts and alkyl pyridinium salts.

The content of the charge control agent in the dispersion of the resin particles is preferably 10 parts by weight or less, more preferably 5 parts by weight or less and even more preferably 3 parts by weight or less on the basis of 100 parts by weight of the resin forming the resin particles in view of a good charging property of the resultant toner. When the charge control agent is contained in the dispersion, the lower limit of the content of the charge control agent in the dispersion is preferably 0.01% by weight in view of a good charging property.

Meanwhile, when the charge control agent is contained in the dispersion of the resin particles, in view of attaining a good dispersibility of the charge control agent therein, there are preferably used a method of previously melt-kneading the charge control agent and the resin forming the resin particles with each other and then emulsifying the resultant kneaded material in an aqueous medium, and a method of dispersing the charge control agent in an aqueous medium to prepared a dispersion, and then emulsifying the resin in an aqueous medium while adding the obtained dispersion of the charge control agent thereto.

The colorant usable in the present invention is not particularly limited, and may be appropriately selected from known colorants. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes and thiazole dyes. These colorants may be used alone or in combination of any two or more thereof.

The content of the colorant in the resin particles is preferably 20 parts by weight or less and more preferably from 0.01 to 10 parts by weight on the basis of 100 parts by weight of the resin forming the resin particles.

Examples of the releasing agent include low-molecular weight polyolefins such as polyethylene, polypropylene and polybutene; silicones exhibiting a softening point upon heating; fatty acid amides such as oleamide, erucamide, ricinolamide and stearamide; vegetable waxes such as carnauba wax, rice wax, candelilla wax, haze wax and jojoba oil; animal waxes such as beeswax; mineral and petroleum waxes such as montan wax, ozokerite, ceresin, paraffin wax, microcrystalline wax and Fischer-Tropsch wax; and the like. These releasing agents are preferably used in the form of a dispersion in an aqueous medium in view of a good dispersibility thereof and a good aggregation thereof with the resin particles.

The content of the releasing agent in the resin particles is preferably from 1 to 20 parts by weight and preferably from 2 to 15 parts by weight on the basis of 100 parts by weight of the resin forming the resin particles in view of attaining good effects due to addition thereof and preventing adverse influence thereof from exerting on chargeability.

In the present invention, upon emulsifying the resin in the aqueous medium, from the viewpoints of a good emulsifiability of the resin, etc., a surfactant is caused to be present in an amount of preferably 5 parts by weight or less, more preferably from 0.1 to 3.5 parts by weight and even more preferably from 0.1 to 3 parts by weight on the basis of 100 parts by weight of the resin forming the resin particles.

Examples of the surfactant include anionic surfactants such as sulfate-based surfactants, sulfonate-based surfactants, phosphate-based surfactants and soap-based surfactants; cationic surfactants such as amine salt-type surfactants and quaternary ammonium salt-type surfactants; and nonionic surfactants such as polyethylene glycol-based surfactants, alkyl phenol ethyleneoxide adduct-based surfactants and polyhydric alcohol-based surfactants. Among these surfactants, preferred are ionic surfactants such as anionic surfactants and cationic surfactants. Specific examples of the anionic surfactants include dodecylbenzenesulfonic acid, sodium dodecylbenzenesulfonate, sodium dodecylsulfate, sodium alkylethersulfates, sodium alkylnaphthalenesulfonates and sodium dialkylsulfosuccinates. Specific examples of the cationic surfactants include alkylbenzenedimethyl ammonium chlorides, alkyltrimethyl ammonium chlorides and distearyl ammonium chloride. The nonionic surfactant is preferably used in combination with the anionic surfactant or the cationic surfactant. These surfactants may be used alone or in combination of any two or more thereof.

Also, in the emulsification step, the resin is preferably dispersed together with optional additives in the aqueous medium by adding an aqueous alkali solution thereto.

The aqueous alkali solution used for dispersing the resin preferably has a concentration of from 1 to 20% by weight, more preferably from 1 to 10% by weight and even more preferably from 1.5 to 7.5% by weight. As the alkali contained in the aqueous alkali solution, there may be used such an alkali which allows a salt of the alkali and the polyester to exhibit an enhanced surface activity. Specific examples of the alkali include hydroxides of a monovalent alkali metal such as potassium hydroxide and sodium hydroxide.

After dispersing the resin forming the resin particles in the aqueous medium, the resultant dispersion is neutralized at a temperature not lower than a glass transition point of the resin forming the resin particles, and then an aqueous medium is added thereto at a temperature not lower than the glass transition point of the resin to cause a phase inversion and emulsify the resin, thereby preparing the resin dispersion.

The rate of addition of the aqueous medium is preferably from 0.5 to 50 g/min, more preferably from 0.5 to 40 g/min and even more preferably from 0.5 to 30 g/min per 100 g of the resin forming the resin particles from the viewpoint of efficiently conducting the emulsifying step. The rate of addition of the aqueous medium may be generally maintained until an O/W type emulsion is substantially formed. Therefore, the rate of addition of the aqueous medium after forming the O/W type emulsion is not particularly limited.

Examples of the aqueous medium used upon production of the dispersion of the resin particles include the same aqueous media as described above.

The amount of the aqueous medium used is preferably from 100 to 2000 parts by weight and more preferably from 150 to 1500 parts by weight on the basis of 100 parts by weight of the resin forming the resin particles from the viewpoint of obtaining uniform aggregated particles in the subsequent aggregating treatment.

From the viewpoint of preparing a dispersion containing fine resin particles, the above dispersing procedure is preferably conducted at a temperature not lower than the glass transition point of the resin forming the resin particles and not higher than the softening point thereof. When the emulsification is conducted in the above-specified temperature range, the resin can be smoothly emulsified in the aqueous medium, and any special apparatus is not required therefor. From these viewpoints, the temperature used for the emulsification is preferably not lower than the temperature which is higher by 10° C. than the glass transition point of the resin forming the resin particles (the temperature calculated from the "glass transition point of the resin forming the resin particles+(plus) 10° C.") and not higher than the temperature which is lower by 5° C. than the softening point of the resin forming the resin particles (the temperature calculated from the "softening point of the resin forming the resin particles−(minus) 5° C.").

The volume median particle size (D50) of the resin particles contained in the thus obtained dispersion is preferably from 0.02 to 2 μm, more preferably from 0.05 to 1 μm and even more preferably from 0.05 to 0.6 μm for the purpose of uniform aggregation thereof in the subsequent aggregating treatment. Meanwhile, the volume median particle size (D50) used herein means a particle size at which a cumulative volume frequency calculated on the basis of a volume fraction of particles from a smaller particle size side thereof is 50%. The volume median particle size may be measured by the below-mentioned method.

As an alternative method for obtaining the dispersion containing the resin particles, there may be used, for example, the method of emulsifying and dispersing a polycondensable monomer as a raw material of the aimed resin particles in an aqueous medium, for example, by applying a mechanical shearing force or an ultrasonic wave thereto. In this method, if required, additives such as a polycondensation catalyst and a surfactant may also be added to the aqueous medium. The polycondensation reaction of the monomer is allowed to proceed, for example, by heating the obtained mixture. For example, when using a polyester as the resin binder, there may be used the polycondensable monomers and the polycondensation catalysts for the above polyesters, and as the surfactant, there may also be used those as described above.

The polymerization of the polycondesable monomer for producing the polycondensed resin is usually accompanied with a dehydration reaction thereof and, therefore, does not principally proceed in the aqueous medium. However, for example, when the polycondesable monomer is emulsified in the aqueous medium in the presence of a surfactant capable of forming a micelle in the aqueous medium, the monomer is present in a micro hydrophobic site in the micelle and is subjected to dehydration reaction to produce water. By discharging the thus produced water into the aqueous medium outside of the micelle, the polymerization of the monomer can proceed. Thus, the aimed dispersion containing the polycondensed resin particles emulsified and dispersed in the aqueous medium can be obtained even under an energy saving condition.

Step of Producing Aggregated Particles as Core Particles

In this step, in order to effectively carry out the aggregation, an aggregating agent is preferably added. Examples of the aggregating agent include a cationic surfactant in the form of a quaternary salt, an organic aggregating agent such as polyethyleneimine, and an inorganic aggregating agent such as an inorganic metal salt, an ammonium salt and a di- or higher-valent metal complex. The inorganic metal salt includes, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide)

and poly(calcium sulfide). In the present invention, from the viewpoints of controlling a particle size of the toner with a high accuracy and achieving a narrow particle size distribution thereof, a monovalent salt is preferably used as the aggregating agent. The "monovalent salt" used herein means that a valence of a metal ion or a cation constituting the salt is 1. Examples of the monovalent salt as the aggregating agent include organic aggregating agents such as cationic surfactants in the form of a quaternary salt, and inorganic aggregating agents such as inorganic metal salts and ammonium salts. In the present invention, among these aggregating agents, from the viewpoints of controlling a particle size of the toner with a high accuracy and achieving a narrow particle size distribution thereof, preferred are water-soluble nitrogen-containing compounds having a molecular weight of 350 or less.

The water-soluble nitrogen-containing compounds having a molecular weight of 350 or less are preferably acidic compounds in order to rapidly aggregate the resin particles. The pH value of an aqueous solution containing 10% by weight of the water-soluble nitrogen-containing compound is preferably from 4 to 6 and more preferably from 4.2 to 6 as measured at 25° C. Also, from the viewpoints of a good charging property under high-temperature and high-humidity conditions, etc., the water-soluble nitrogen-containing compounds preferably have a molecular weight of 350 or less and more preferably 300 or less. Examples of the water-soluble nitrogen-containing compounds include ammonium salts such as ammonium halides, ammonium sulfate, ammonium acetate, ammonium benzoate and ammonium salicylate; and quaternary ammonium salts such as tetraalkyl ammonium halides. From the viewpoint of a good productivity, among these compounds, preferred are ammonium sulfate (pH value of 10 wt % aqueous solution thereof as measured at 25° C. (hereinafter referred to merely as a "pH"): 5.4), ammonium chloride (pH: 4.6), tetraethyl ammonium bromide (pH: 5.6) and tetrabutyl ammonium bromide (pH: 5.8).

The amount of the aggregating agent used varies depending upon the valence of electric charge of the aggregating agent used. When using a monovalent aggregating agent, the amount of the aggregating agent used is preferably from 2 to 50 parts by weight, more preferably from 3.5 to 40 parts by weight and even more preferably from 3.5 to 30 parts by weight on the basis of 100 parts by weight of the resin forming the resin particles from the viewpoint of a good aggregating property.

In order to ensure a uniform aggregation, the aggregating agent is preferably added after controlling the pH of the reaction system and at a temperature not higher than the glass transition point of the resin forming the resin particles and preferably at a temperature not higher than the temperature calculated from the "glass transition point of the resin−(minus) 10° C.". Also, the aggregating agent may be added in the form of an aqueous medium solution thereof. In addition, the aggregating agent may be added to the dispersion at one time, or intermittently or continuously. Further, upon and after addition of the aggregating agent, the dispersion obtained is preferably fully stirred.

The volume median particle size (D50) of the aggregated particles as the core particles obtained in the step (A) is preferably from 1 to 10 μm, more preferably from 2 to 8 μm and even more preferably from 3 to 8 μm from the viewpoints of a high image quality and a uniform adhesion of the composite fine particles thereto in the step (B).

The core particles subjected to the step (B) may be in the form of either the aggregated particles themselves or coalesced particles obtained from the aggregated particles in the below-mentioned step (C). However, in view of a good adhesion of the composite fine particles to the core particles, the non-coalesced aggregated particles are preferably used as the core particles.

The solid content of the aggregated particles in the dispersion obtained in the step (A) is preferably from 5 to 50% by weight and more preferably from 5 to 40% by weight in view of a good productivity and a well-controlled aggregation.

[Step (B)]

In the step (B), the composite fine particles containing a polyester-containing resin and a charge control agent, preferably a dispersion thereof, or the composite fine particles containing "fine particles of the polyester-containing resin" and "fine particles of the charge control agent", preferably a dispersion thereof, are added to the core particles obtained in the step (A), preferably a dispersion thereof, to allow the composite fine particles to adhere onto the core particles, thereby obtaining "composite fine particle-adhering core particles" (i.e. core particles onto which composite fine particles adhered), preferably a dispersion thereof.

Resins Forming Composite Fine Particles

The resin forming the composite fine particles contains a polyester. The content of the polyester in the resin forming the composite fine particles is preferably 60% by weight or larger, more preferably 70% by weight or larger, even more preferably 80% by weight or larger and further even more preferably substantially 100% by weight from the viewpoints of a good fixing property and a good durability of the resultant toner. The kind of the polyester and other resins than the polyester may be the same as those used for the resin forming the above aggregating particles as the core particles. The polyester used in the composite fine particles may be produced from the same monomers as those for obtaining the polyester contained in the resin forming the above aggregated particles as the core particles.

In view of a good durability and a good storage property, the glass transition point of the resin forming the composite fine particles is preferably higher than that of the resin forming the core particles. The difference between the glass transition points of these resins is preferably from 3 to 20° C. and more preferably from 5 to 20° C.

When an acid group-containing resin is used in the resin forming the composite fine particles, from the viewpoint of reducing adverse influence due to change in environmental conditions, the acid value of the resin forming the composite fine particles is preferably lower than that of the resin forming the core particles, more specifically, the acid value of the former resin is preferably lower by 3 mg KOH/g or more, and more preferably lower by 5 mg KOH/g or more, than the acid value of the latter resin.

Charge Control Agent

Examples of the charge control agent include metal salts of benzoic acid, metal salts of salicylic acid, metal salts of alkylsalicylic acids, metal salts of catechol, metal-containing bisazo dyes, tetraphenyl borate derivatives, quaternary ammonium salts and alkyl pyridinium salts. Among these charge control agents, in view of a good charging property, preferred are metal salts of salicylic acid and quaternary ammonium salts, and more preferred are metal salts of salicylic acid. The metal salts of salicylic acid are preferably compounds represented by the following formula (1):

(1)

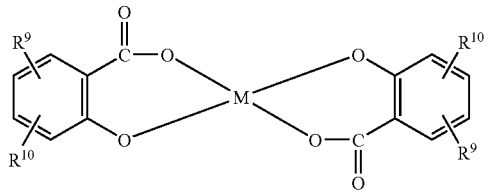

*** wherein $R^9$ and $R^{10}$ are respectively an alkyl group having 1 to 8 carbon atoms and preferably a tert-butyl group; and M is chromium, iron or zinc.

Examples of commercial products of the metal salts of salicylic acid include "BONTRON E-81" (metal: chromium) and "BONTRON E-84" (metal: zinc) both available from Orient Chemical Industry Co., Ltd.

The content of the charge control agent in the composite fine particles is preferably from 0.01 to 10 parts by weight, more preferably from 0.01 to 7.5 parts by weight and even more preferably from 0.01 to 5 parts by weight on the basis of 100 parts by weight of the resin forming the composite fine particles.

Production of Composite Fine Particles

The composite fine particles used in the present invention may be in the form of either composite fine particles containing a polyester-containing resin and a charge control agent, or composite fine particles containing "fine particles of the polyester-containing resin" and "fine particles of the charge control agent". More specifically, when producing the dispersion containing the composite fine particles, a dispersion containing the charge control agent (also referred to as a dispersion of "fine particles of the charge control agent") and a dispersion containing the polyester-containing resin (also referred to as a dispersion of "fine particles of the polyester-containing resin") may be each independently or separately prepared. Alternatively, the dispersion containing the composite fine particles may be produced in the form of a dispersion of composite fine particles containing the polyester-containing resin incorporated with the charge control agent (also referred to as a dispersion of "fine particles of the charge control agent-containing resin").

Production of "Fine Particles of the Charge Control Agent" and Fine Particles of Resin Containing Polyester-Containing Resin The dispersion of "fine particles of the charge control agent" may be produced by mixing and dispersing the charge control agent, if required, together with a surfactant, in an aqueous medium using a mixer such as a homomixer. The kind and amount of the surfactant used are the same as those used for producing the emulsion of the resin forming the resin particles in the step (A).

In addition, the dispersion of "fine particles of the polyester-containing resin" may also be produced by the same method as used for producing the dispersion of the resin particles in the above step (A).

Production of Composite Fine Particles Containing Polyester-Containing Resin Incorporated with Charge Control Agent The dispersion of "fine particles of the charge control agent-containing resin" may be produced by (1) the method of adding the polyester-containing resin and the charge control agent to the same system, and emulsifying these components therein; (2) the method of previously melt-kneading the charge control agent with the polyester-containing resin and then emulsifying the resultant kneaded material in an aqueous medium; or (3) the method of dispersing the charge control agent in an aqueous medium to prepare a dispersion thereof, and then emulsifying the polyester-containing resin in an aqueous medium while adding the obtained dispersion of the charge control agent thereto. Meanwhile, in these methods, since the polyester-containing resin is emulsified in the presence of the charge control agent, it is considered that the resultant emulsified particles ("fine particles of the charge control agent-containing resin") has such a structure in which the charge control agent is enclosed within the polyester-containing resin.

Upon producing the dispersion of the composite fine particles containing the polyester-containing resin and the charge control agent, in order to emulsify the resin forming the composite fine particles, a surfactant is preferably used similarly to the method of producing the emulsion of the resin in the step (A). The suitable kind and amount of the surfactant may be the same as those used in the above method of producing the emulsion of the resin. In this case, the "resin particles" described in the method of producing the emulsion of the resin should be read as the "composite fine particles".

The dispersion of the composite fine particles may also contain, in addition to the above polyester-containing resin and charge control agent, various additives such as a colorant and a releasing agent, if required. The colorant and releasing agent usable in the dispersion of the composite fine particles may be the same as those used for producing the dispersion of the resin particles in the step (A). When the dispersion containing "fine particles of the polyester-containing resin" and the dispersion containing "fine particles of the charge control agent" are each independently or separately produced, these additives may be added to either one or both of the dispersions.

The solid content of the composite fine particles in the dispersion is preferably from 5 to 50% by weight, more preferably from 5 to 40% by weight and even more preferably from 10 to 35% by weight in view of a good stability of the dispersion and a uniform adhesion of the composite fine particles to the aggregated particles.

The "fine particles of the charge control agent", the "fine particles of the polyester-containing resin" and the composite fine particles contained in the thus obtained dispersion of the composite fine particles respectively have a volume median particle size (D50) of preferably from 0.05 to 2 μm, more preferably from 0.05 to 1 μm, even more preferably from 0.05 to 0.5 μm and further even more preferably from 0.05 to 0.3 μm in order to uniformly aggregate these fine particles.

Meanwhile, in the present invention, when the core particles are produced by the emulsification aggregating method, the dispersion of the composite fine particles which is produced in the step (B) may also be used as the dispersion of the resin particles in the step (A). In this case, the dispersion of the composite fine particles and the composite fine particles should be read as the "dispersion of the resin particles" and the "resin particles", respectively.

Step of Producing "Composite Fine Particle-Adhering Core Particles"

In the step (B), the dispersion of the composite fine particles containing the polyester-containing resin and the charge control agent, or the dispersion of the composite fine particles containing the "fine particles of the polyester-containing resin" and the "fine particles of the charge control agent", is added to the dispersion of the core particles obtained in the step (A). As the method of adding the dispersion of the composite fine particles, there is preferably used the method of adding the dispersion containing the "fine particles of the charge control agent" and the dispersion containing the "fine particles of the polyester-containing resin" each independently, at the same time, alternately or in the form of a mixture thereof to allow the composite fine particles to adhere onto the surface of the respective core particles; the method of adding the dispersion of "fine particles of the charge control agent-containing resin"; or the like. From the viewpoints of reducing a particle size of the composite fine particles and attaining a narrow particle size distribution of the resultant toner, among these methods, preferred is the method of adding the dispersion of "fine particles of the charge control agent-containing resin".

In the present invention, the step (B) is preferably a step of adding the dispersion of the composite fine particles containing the charge control agent and the polyester-containing resin, or the dispersion of the composite fine particles composed of the "fine particles of the polyester-containing resin" and the "fine particles of the charge control agent", to the dispersion containing the aggregated particles as the core particles dispersed in the aqueous medium which are obtained in the step (A) to allow the composite fine particles to adhere onto the surface of the respective aggregated particles, thereby obtaining the "composite fine particle-adhering core particles", and more preferably a step of adding the dispersion of "fine particles of the charge control agent-containing resin" to the dispersion containing the aggregated particles to allow the composite fine particles to adhere onto the surface of the respective aggregated particles, thereby obtaining the "composite fine particle-adhering core particles" (also referred to as charge control agent-adhering aggregated particles).

The time of adding the dispersion of the composite fine particles may be appropriately controlled according to the amount of the composite fine particles to adhere onto the aggregated particles and the volume median particle size (D50) of the aimed toner. Meanwhile, in the emulsification aggregating method, in order to produce a toner having a volume median particle size (D50) of 5 μm by coating the surface of the respective aggregated particles as the core particles with the composite fine particles to form a 1 μm-thick coating layer of the composite fine particles thereon, the composite fine particles may be added and allowed to adhere onto the surface of the respective aggregated particles at the stage at which the aggregated particles are grown into 4 μm in particle size.

The weight ratio of the composite fine particles added to the core particles may be controlled such that the amount of the resin contained in the composite fine particles is preferably from 5 to 100 parts by weight, more preferably from 10 to 90 parts by weight and even more preferably from 20 to 80 parts by weight on the basis of 100 parts by weight of the resin contained in the core particles, from the viewpoint of a uniform charging property of the resultant toner.

In the step (B), the dispersion of the composite fine particles may be added at one time, or may be intermittently added plural times by dividing the dispersion into plural parts. In the present invention, in view of obtaining toner particles having a narrow particle size distribution, the dispersion of the composite fine particles are preferably intermittently added several times by dividing the dispersion into several parts. Meanwhile, in the present invention, when the dispersion of the composite fine particles is continuously added over a predetermined period of time, such an addition is regarded as the one-time addition.

Upon producing the core particles by the emulsification aggregating method, the aggregating agent may be added by the following method when the dispersion of the composite fine particles is added at one time, or is intermittently added plural times by dividing the agent into plural parts. That is, when the amount of the resin forming the composite fine particles added is less than 30 parts by weight on the basis of 100 parts by weight of the resin contained in the core particles, the aggregating agent may be optionally added in view of a well-controlled particle size distribution of the obtained "composite fine particle-adhering core particles". On the other hand, when the amount of the resin forming the composite fine particles added is 30 parts by weight or more on the basis of 100 parts by weight of the resin contained in the core particles, the aggregating agent is preferably added in view of a good aggregating property and a well-controlled particle size distribution of the obtained "composite fine particle-adhering core particles". In the latter case, the composite fine particles and the aggregating agent are preferably added each independently at the same time, or alternately, and more preferably added each independently at the same time.

In the step (B), when the dispersion of the composite fine particles is intermittently added plural times by dividing the dispersion into plural parts, the amounts of the composite fine particles contained in the divided plural parts of the dispersion are preferably the same. Also, when the aggregated agent is intermittently added plural times by dividing the agent into plural parts, the amounts of the aggregating agent contained in the divided plural parts are preferably the same. Further, when the dispersion of the composite fine particles is intermittently added plural times by dividing the dispersion into plural parts, the number of the plural addition times is not particularly limited. In view of a well-controlled particle size distribution of the obtained "composite fine particle-adhering core particles" and a good productivity, the number of the plural addition times is preferably from 2 to 10 (times) and more preferably from 2 to 8 (times).

In addition, upon producing the core particles by the emulsification aggregating method, in view of a good aggregating property and a well-controlled particle size distribution of the obtained "composite fine particle-adhering core particles", after adding the respective divided parts of the dispersion of the composite fine particles plural times, the resultant dispersion is aged for a period of preferably from 5 to 15 min, more preferably from 5 to 30 min and even more preferably from 5 min to 2 h. More preferably, the aging time is provided after all the plural addition times. Meanwhile, the aging time means a period elapsed from termination of the addition of one part of the aggregating agent and/or the dispersion of the composite fine particles to initiation of the addition of the next part thereof.

The amount of the aggregating agent used is preferably from 1 to 30 parts by weight, more preferably from 2 to 28 parts by weight and even more preferably from 3 to 25 parts by weight on the basis of 100 parts by weight of the composite fine particles in view of reducing a particle size of the obtained toner particles and achieving a narrow particle size distribution thereof. Meanwhile, as the aggregating agent, there may be used the same aggregating agent as used in the step (A). The aggregating agent is preferably dissolved in an aqueous medium and added in the form of an aqueous solution.

In the step (B), the composite fine particles or the dispersion thereof are added to the dispersion containing the core particles while maintaining the dispersion containing the core particles at a temperature of preferably from (T1−25) to (T1+5)° C., more preferably from (T1−25) to T1° C. and even more preferably from (T1−20) to T1° C., thereby enabling the composite fine particles to uniformly adhere onto the surface of the respective core particles. Meanwhile, "T1" means the lower one of a glass transition point of the resin forming the core particles and a glass transition point of the resin forming the composite fine particles.

The thus formed "composite fine particle-adhering core particles" usually have such a structure in which the composite fine particles are aggregated and deposited onto the surface of the respective core particles, i.e., a so-called capsulated structure.

In the preferred embodiment of the present invention, when the volume median particle size (D50) of the core particles is from 2 to 6 μm and the volume median particle size (D50) of the composite fine particles is from 120 to 180 μm, in view of achieving a narrow particle size distribution of the obtained toner particles and a good productivity, the rate of addition of the composite fine particles may be controlled such that the amount of the resin forming the composite fine particles added is preferably from 0.01 to 3 parts by weight/min, more preferably from 0.01 to 2 parts by weight/min and even more preferably from 0.01 to 1 part by weight/min on the basis of 100 parts by weight of the resin forming the core particles.

The rate of addition of the composite fine particles varies depending upon the volume median particle size (D50) of the core particles and the volume median particle size (D50) of the composite fine particles. When the difference in particle size between the core particles and the composite fine particles is larger than that described in the above preferred embodiment, the rate of addition of the composite fine particles is preferably lowered. When the difference in particle size between the core particles and the composite fine particles is smaller than that described in the above preferred embodiment, the rate of addition of the composite fine particles may be enhanced.

Further, when the solid content of the dispersion of the core particles obtained in the step (A) (amount of the core particles) and the solid content of the dispersion of the composite fine particles obtained in the step (B) (amount of the composite fine particles) are respectively within 5% by weight, in view of a good aggregating property and a good productivity, the rate of addition of the composite fine particles is controlled such that the amount of the resin forming the composite fine particles added is preferably from 0.05 to 2.0 parts by weight/min, more preferably from 0.05 to 1.5 parts by weight/min and even more preferably from 0.01 to 1.0 part by weight/min on the basis of 100 parts by weight of the resin contained in the core particles.

In the step (B), in view of a well-controlled particle size distribution of the obtained toner particles, after the dispersion of the composite fine particles is added to allow the composite fine particles to adhere onto the core particles, the above surfactant is preferably added thereto, and more preferably at least one salt selected from the group consisting of alkylethersulfuric acid salts which are represented by the following formula (1), alkylsulfuric acid salts and linear alkylbenzenesulfonic acid salts is added thereto.

$$R—O—(CH_2CH_2O)_nSO_3M \quad (1)$$

wherein R is an alkyl group; n represents an average molar number of addition and is from 0 to 15, and M is a monovalent cation.

The alkyl group as R in the formula (1) is an alkyl group having preferably 6 to 20 carbon atoms, more preferably 8 to 18 carbon atoms and even more preferably 8 to 15 carbon atoms from the viewpoint of a good adsorption of the salt to the aggregated particles and a small residual amount of the salt in the toner. Specific examples of the alkyl group include octyl, decyl, dodecyl, tetradecyl, pentadecyl and octadecyl. The suffix n represents an average molar number of addition and is from 0 to 15. From the viewpoint of a well-controlled particle size, the suffix n is preferably from 1 to 10 and more preferably from 1 to 5. M is a monovalent cation. From the viewpoint of a well-controlled particle size, M is preferably sodium, potassium or ammonium, and more preferably sodium or ammonium.

Also, the linear alkylbenzenesulfonic acid salts are not particularly limited. From the viewpoints of a good adsorption into the aggregated particles and a small residual amount in the toner, the linear alkylbenzenesulfonic acid salts are preferably those salts represented by the following formula (2):

$$R\text{-}Ph\text{-}SO_3M \quad (2)$$

wherein R is a linear alkyl group; Ph is a phenyl group; and M is a monovalent cation. The linear alkyl group as R in the formula (2) may be the same as linear ones among the alkyl groups exemplified as R in the formula (1). Examples of the linear alkyl group include octyl, decyl, dodecyl, tetradecyl and octadecyl. As the suitable linear alkylbenzenesulfonic acid salts, there are preferably used sulfuric acid sodium salts thereof.

The above alkylethersulfuric acid salts, alkylsulfuric acid salts and linear alkylbenzenesulfonic acid salts may be used alone or in combination of any two or more thereof.

The at least one salt selected from the group consisting of the above alkylethersulfuric acid salts, alkylsulfuric acid salts and linear alkylbenzenesulfonic acid salts is added in an amount of preferably from 0.1 to 15 parts by weight, more preferably from 0.1 to 10 parts by weight and even more preferably from 0.1 to 8 parts by weight on the basis of 100 parts by weight of the resins forming the "composite fine particle-adhering core particles" (i.e., a total amount of the resin forming the core particles and the resin forming the composite fine particles) from the viewpoints of a good aggregation stopping property and a small residual amount in the resultant toner. As long as the amount of the salt added lies within the above specified range, the salt may be added in any configuration. However, in view of a good productivity, the salt is preferably added in the form of an aqueous solution. The above respective salts may be added at one time, or intermittently or continuously.

In the step (B), from the viewpoint of a high image quality, the volume median particle size (D50) of the "composite fine particle-adhering core particles" is preferably from 1 to 10 μm, more preferably from 2 to 10 μm and even more preferably from 3 to 10 μm.

[Step (C)]

The step (C) is a step of heating the "composite fine particle-adhering core particles" obtained in the step (B), preferably the dispersion thereof, to produce coalesced particles, more specifically, a step of fusing the core particles and the composite fine particles contained in the "composite fine particle-adhering core particles" obtained in the step (B) to produce coalesced particles. In the case where the core particles are produced by the emulsification aggregating method, in the step (C), by heating the "composite fine particle-adhering core particles", the aggregated particles as the core particles contained in the "composite fine particle-adhering core particles" obtained in the step (B) are coalesced together, and at the same time the composite fine particles are fused thereonto, thereby obtaining the aimed coalesced particles.

Thus, in the present invention, it is preferred that the "composite fine particle-adhering core particles" obtained in the step (B) are heated to not only coalesce the aggregated particles as the core particles, but also at the same time fuse the composite fine particles onto the aggregated particles and/or the coalesced particles obtained by coalescing the aggregated particles, thereby obtaining the aimed coalesced particles. More specifically, the "composite fine particle-adhering core particles" obtained in the step (B) have such a configuration in which the resin particles contained in the aggregated particles as the core particles, the composite fine particles contained in the "composite fine particle-adhering core particles", and the core particles and the composite fine particles contained in the "composite fine particle-adhering core particles", are respectively merely electrically attached to/contacted with each other. However, in the step (C), the aggregated particles as the core particles are integrally coalesced together, and at the same time the composite fine particles are integrally fused together or integrally fused onto the surface of the respective aggregated particles as the core particles and/or the respective coalesced particles thereof, thereby obtaining the aimed coalesced particles.

The heating temperature used upon the step (C) is preferably not lower than the glass transition point of the resin forming the composite fine particles and not higher than the temperature calculated from the "softening point of the resin+(plus) 20° C."; more preferably not lower than the temperature calculated from the "grass transition point of the resin+(plus) 5° C." and not higher than the temperature calculated from the "softening point of the resin+(plus) 15° C."; and even more preferably not lower than the temperature calculated from the "grass transition point of the resin+(plus) 10° C." and not higher than the temperature calculated from the "softening point of the resin+(plus) 10° C." from the viewpoints of well controlling a particle size, a particle size distribution and a shape of the toner as desired, and attaining a good fusibility of the charge control agent-adhering aggregated particles. In addition, the stirring rate used in the step (C) is preferably a rate at which the aggregated particles are not precipitated.

Meanwhile, the above description is concerned merely with unification caused in the single composite fine particle, and not with unification caused between the "composite fine particle-adhering core particles".

The thus obtained coalesced particles may be subjected to a liquid-solid separation step such as filtration, a washing step, a drying step, etc., thereby obtaining toner particles. In the washing step, the coalesced particles are preferably washed with an acid to remove metal ions from the surface of the respective toner particles for the purpose of ensuring a sufficient chargeability and a good reliability of the resultant toner.

In addition, in the drying step, any optional methods such as vibration-type fluidization drying method, spray-drying method, freeze-drying method and flash jet method may be employed. The water content in the toner particles obtained after drying is preferably adjusted to 1.5% by weight or less and more preferably 1.0% by weight or less from the viewpoint of a good chargeability of the resulting toner.

The volume median particle size (D50) of the coalesced particles is preferably from 1 to 10 μm, more preferably from 2 to 8 μm and even more preferably from 3 to 8 μm from the viewpoint of a high image quality.

[Toner for Electrophotography]

The toner for electrophotography according to the present invention is produced by the above production process including the steps (A), (B) and (C), and has a small particle size suitable for achieving a high definition and a high image quality which is well controlled with a high accuracy, and exhibits a narrow particle size distribution, an excellent charging property and an excellent fixing property. More specifically, the toner of the present invention is produced by the process including the steps of (A) forming resin-containing core particles having a volume median particle size (D50) of from 1 to 10 μm in an aqueous medium; (B) adding composite fine particles containing a polyester-containing resin and a charge control agent, preferably a dispersion thereof, or composite fine particles containing "fine particles of the charge control agent" and "fine particles of the polyester-containing resin", preferably a dispersion thereof, to the core particles obtained in the step (A), preferably a dispersion thereof, to allow the composite fine particles to adhere onto the core particles, thereby obtaining "composite fine particle-adhering core particles", preferably a dispersion thereof; and (C) heating the "composite fine particle-adhering core particles" obtained in the step (B), preferably the dispersion of the "composite fine particle-adhering core particles", to obtain coalesced particles; or by the process including the steps of (A) aggregating resin particles contained in a dispersion of the resin particles to obtain aggregated particles as core particles; (B) adding composite fine particles containing a polyester-containing resin and a charge control agent, preferably a dispersion thereof, or composite fine particles containing "fine particles of the polyester-containing resin" and "fine particles of the charge control agent", preferably a dispersion thereof, to the aggregated particles as core particles obtained in the step (A), to allow the composite fine particles to adhere onto the aggregated particles, thereby obtaining "composite fine particle-adhering core particles", preferably a dispersion thereof; and (C) heating the "composite fine particle-adhering core particles" obtained in the step (B), preferably the dispersion of the "composite fine particle-adhering core particles", to obtain coalesced particles. The details of the step (A), the step (B) and the step (C) are respectively the same as those described above.

The obtained toner preferably has a softening point of from 60 to 140° C., more preferably from 60 to 130° C. and even more preferably from 60 to 120° C. from the viewpoint of a good low-temperature fixing property. In addition, the toner preferably has a glass transition point of from 30 to 80° C. and more preferably from 40 to 70° C. from the viewpoint of a good durability. Meanwhile, the softening point and the glass transition point of the toner may be measured according to the same methods as used for measuring those of the resins.

The content of the colorant in the toner is preferably 20 parts by weight or less and more preferably from 0.01 to 10 parts by weight on the basis of 100 parts by weight of a sum of the resin forming the resin particles and the resin forming the resin fine particles.

The total content of the charge control agent in the toner is preferably from 0.01 to 10 parts by weight, more preferably from 0.01 to 7.5 parts by weight and even more preferably from 0.01 to 5 parts by weight on the basis of 100 parts by weight of a sum of the resin forming the core particles and the resin forming the composite fine particles.

The toner particles obtained by the above production processes may be directly used as the toner of the present invention. Alternatively, the toner of the present invention may be those produced by adding an external additive such as a fluidizing agent to the surface of the toner particles. As the external additive, there may be used known fine particles. Examples of the fine particles include inorganic fine particles such as fine silica particles whose surface is subjected to a hydrophobic treatment, fine titanium oxide particles, fine alumina particles, fine cerium oxide particles and carbon blacks;

and fine polymer particles such as fine particles made of polycarbonates, polymethyl methacrylate, silicone resins, etc.

The amount of the external additive blended is preferably from 1 to 5 parts by weight and more preferably from 1.5 to 3.5 parts by weight on the basis of 100 parts by weight of the toner before being treated with the external additive.

The volume median particle size (D50) of the toner particles is preferably from 1 to 10 μm, more preferably from 2 to 8 μm and even more preferably from 3 to 8 μm from the viewpoint of a high image quality. Also, the CV values of the above aggregated particles, coalesced particles and toner particles all are preferably 30 or less and more preferably 27 or less. Thus, the toner of the present invention preferably has the particle size and CV value as specified above. The particle size and the particle size distribution of the toner particles may be measured by the below-mentioned methods. The toner for electrophotography obtained according to the present invention can be used as one-component system developer, or can be mixed with a carrier to form a two-component system developer.

In the process for producing a toner for electrophotography according to the present invention, the charge control agent can be allowed to exist on the surface of the toner, and the resultant toner can have a small particle size and a narrow particle size distribution. In addition, by using the above production process, it is possible to provide a toner for electrophotography which can exhibit excellent image-forming characteristics.

In accordance with the production processes of the present invention, since the charge control agent can be allowed to exist onto the surface of the toner and the resultant toner can have a small particle size and a narrow particle size distribution, the toner of the present invention can be suitably used in electrophotography, electrostatic recording method, electrostatic printing method or the like.

The present invention is described in more detail by referring to the following examples. However, it should be noted that these examples are only illustrative and not intended to limit the invention thereto.

In the following Examples, etc, various properties were measured and evaluated by the following methods.

[Acid Value of Resins]

Determined according to JIS K0070. However, as the solvent for the measurement, there was used a mixed solvent containing acetone and toluene at a volume ratio of 1:1.

[Softening Point and Glass Transition Point of Resins and Toners]

(1) Softening Point

Using a flow tester "CFT-500D" available from Shimadzu Seisakusho Co., Ltd., 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half the amount of the sample was flowed out when plotting a downward movement of the plunger of the flow tester relative to the temperature.

(2) Glass Transition Point

Using a differential scanning calorimeter ("DSC 210" commercially available from Seiko Instruments, Inc.), a sample was heated to 200° C. and then cooled from 200° C. to −10° C. at a temperature drop rate of 10° C./min, and thereafter heated again at temperature rise rate of 10° C./min to measure a glass transition point thereof. When a peak was observed at a temperature lower by 20° C. or more than the softening point, the peak temperature was read as the glass transition point. Whereas, when a shift of the characteristic curve was observed without any peaks at the temperature lower by 20° C. or more than the softening point, the temperature at which a tangential line having a maximum inclination of the curve in the portion of the curve shift was intersected with an extension of the baseline on the high-temperature side of the curve shift was read as the glass transition point. Meanwhile, the glass transition point is a property inherent to an amorphous portion of the resin, which may be generally observed in an amorphous polyester, or may also be observed in an amorphous portion of a crystalline polyester in some cases.

[Number-Average Molecular Weight of Resins]

The number-average molecular weight was calculated from the molecular weight distribution measured by gel permeation chromatography according to the following method.

(1) Preparation of Sample Solution

The resin was dissolved in chloroform to prepare a solution having a concentration of 0.5 g/100 mL. The resultant solution was then filtered through a fluororesin filter ("FP-200" commercially available from Sumitomo Electric Industries, Ltd.) having a pore size of 2 μm to remove insoluble components therefrom, thereby obtaining a sample solution.

(2) Determination of Molecular Weight Distribution

Using the below-mentioned analyzer, chloroform was allowed to flow therethrough at a rate of 1 mL/min, and the column was stabilized in a thermostat at 40° C. One hundred microliters of the sample solution was injected to the column to determine a molecular weight distribution of the sample. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^4$ and $1.02\times10^5$ available from Tosoh Corporation; and those polystyrenes having molecular weights of $2.10\times10^3$, $7.00\times10^3$ and $5.04\times10^4$ available from GL Science Co., Ltd.) as standard samples.

Analyzer: CO-8010 (commercially available from Tosoh Corporation)

Column: GMHLX+G3000HXL (commercially available from Tosoh Corporation)

[Particle Size and Particle Size Distribution of Resin Particles, Fine Particles of Charge Control agent, Fine Particles of Polyester-Containing Resin, Composite Fine Particles Containing Polyester-Containing Resin Incorporated with Charge Control Agent, and Fine Particles of Releasing Agent]

(1) Measuring Apparatus: Laser diffraction particle size analyzer ("LA-920" commercially available from Horiba Seisakusho Co., Ltd.)

(2) Measuring Conditions: Using a cell for the measurement which was filled with distilled water, a volume median particle size (D50) and a volume-average particle size (D4) of the particles were measured at a temperature at which an absorbance thereof was fallen within an adequate range. Meanwhile, the volume-average particle size (D4) used herein means an average particle size calculated on the basis of a volume fraction (a volume ratio of particles having a specific particle size to the whole particles) in the obtained particles. The particle size distribution was expressed by the CV value calculated according to the following formula:

$$CV\ \text{Value}=(\text{Standard Deviation of Particle Size Distribution}/\text{Volume-Average Particle Size}\ (D4)\times100).$$

[Solid Content in Emulsion]

Using an infrared moisture meter "FD-230" available from Ketto Kagaku Kenkyusho Co., Ltd., 5 g of the emulsion was dried at 150° C. to measure a water content (%) thereof on a wet base in a measuring mode 96 (monitoring time: 2.5 min/variation range: 0.05%). The solid content in the emulsion was calculated according to the following formula:

$$\text{Solid content (\%)}=100-M$$

wherein M is a water content (%) on a wet base=[(W−W0)/W]×100 wherein W is a weight of the sample before measurement (initial weight of the sample); and W0 is a weight of the sample after measurement (absolute dry weight).

[Particle Size and Particle Size Distribution of Core (Aggregated) Particles, "Composite Fine Particle-Adhering Core Particles", Coalesced Particles and Toner]

Measuring Apparatus: Coulter Multisizer II (commercially available from Beckman Coulter Inc.)

Aperture Diameter: 50 μm

Analyzing Software: Coulter Multisizer AccuComp Ver. 1.19 (commercially available from Beckman Coulter Inc.)

Electrolyte Solution: "Isotone II" (commercially available from Beckman Coulter Inc.)

Dispersing Solution: The dispersing solution was prepared by dissolving "EMULGEN 109P" (commercially available from Kao Corporation; polyoxyethylene lauryl ether; HLB: 13.6) in the above electrolyte solution such that the concentration of "EMULGEN 109P" in the obtained solution was 5% by weight.

Dispersing Conditions: Ten milligrams of a sample to be measured was added to 5 mL of the dispersing solution, and dispersed using an ultrasonic disperser for 1 min. Thereafter, 25 mL of the electrolyte solution was added to the dispersion, and the obtained mixture was further dispersed using the ultrasonic disperser for 1 min to prepare a sample dispersion.

Measuring Conditions: The thus prepared sample dispersion was added to 100 mL of the electrolyte solution, and after controlling a concentration of the resultant dispersion such that the determination for particle sizes of 30000 particles was completed at 20 s, the particle sizes of 30000 particles were measured under such a concentration condition, and a volume median particle size (D50) thereof was determined from the particle size distribution.

Meanwhile, the particle size distribution was expressed by the CV value calculated according to the following formula:

$$CV\text{ Value}=(\text{Standard Deviation of Particle Size Distribution/Volume Median Particle Size }(D50))\times 100.$$

Production Example 1

Production of Polyester A

A four-necked flask equipped with a nitrogen inlet tube, a dehydration tube, a stirrer and a thermocouple was charged with 8320 g of polyoxypropylene (2.2)-2,2-bis(4-hydroxyphenyl)propane, 80 g of polyoxyethylene (2.0)-2,2-bis(4-hydroxyphenyl)propane, 1592 g of terephthalic acid and 32 g of dibutyl tin oxide as an esterification catalyst, and the contents of the flask were reacted with each other in a nitrogen atmosphere under normal pressure (101.3 kPa) at 230° C. for 5 h, and further reacted under reduced pressure. After the obtained reaction product was cooled to 210° C., 1672 g of fumaric acid and 8 g of hydroquinone were added thereto to conduct a reaction therebetween for 5 h, and further the reaction was conducted under reduced pressure, thereby obtaining a polyester A. The polyester A had a softening point of 110° C., a glass transition point of 66° C., an acid value of 24.4 mg KOH/g, and a number-average molecular weight of 3760.

Production Example 2

Production of Polyester B

A four-necked flask equipped with a nitrogen inlet tube, a dehydration tube, a stirrer and a thermocouple was charged with 1750 g of polyoxypropylene (2.2)-2,2-bis(4-hydroxyphenyl)propane, 1625 g of polyoxyethylene (2.0)-2,2-bis(4-hydroxyphenyl)propane, 1145 g of terephthalic acid, 161 g of dodecenyl succinic anhydride, 480 g of trimellitic anhydride and 26 g of tin 2-ethyl-hexanoate, and the contents of the flask were reacted with each other at 220° C. under a nitrogen atmosphere while stirring until the softening point as measured according to ASTM D36-86 reached 120° C., thereby obtaining a polyester B. The polyester B had a softening point of 121° C., a glass transition point of 65° C., an acid value of 21 mg KOH/g and a number-average molecular weight of 3394.

Production Example 3

Production of Master Batch A

Seventy parts by weight of fine powders of the polyester A obtained in Production Example 1 and 30 parts by weight (in terms of a pigment content) of a slurry pigment of copper phthalocyanine ("ECB-301"; solid content: 46.2% by weight) available from Dai-Nichi Seika Co., Ltd., were charged into a Henschel mixer, and mixed with each other for 5 min to obtain a wet mixture. The resulting mixture was charged into a kneader-type mixer and gradually heated. The resin was melted at a temperature of about 90 to 110° C., and the mixture was kneaded under the condition that water was still present therein, and further continuously kneaded at a temperature of 90 to 110° C. for 20 min while evaporating water therefrom.

The resultant kneaded material was continuously kneaded at 120° C. to evaporate residual water therefrom, and dehydrated and dried, and further continuously kneaded at a temperature of 120 to 130° C. for 10 min. After cooling, the obtained kneaded material was further kneaded with a heating three-roll mill, cooled and then coarsely crushed, thereby obtaining a high-concentration colored composition in the form of coarse particles containing 30% by weight of ablue pigment (master batch A). The resultant composition was placed on a slide glass, and heat-melted. As a result of observing the melted composition by using a microscope, it was confirmed that the pigment particles were entirely finely dispersed in the composition, and no coarse particles were present therein.

Production Example 4

Production of Master Batch B

One hundred parts by weight of fine powders of the polyester A and 10 parts by weight of a charge control agent "BONTRON E-84" available from Orient Chemical Industry Co., Ltd., were mixed with each other using a Henschel mixer at a stirring speed of 1500 r/m for 1 min. Thereafter, the obtained mixture was melt-kneaded using a twin-screw type kneader "PCM-30" available from Ikegai Tekko Co., Ltd., at a kneading temperature of 100° C., a feed rate of 10 kg/min and a rotating speed of 200 r/m. The resultant kneaded material was cooled on a cooling belt and then coarsely pulverized using a mill with a 2 mmϕ screen, thereby obtaining a master batch B.

Production Example 5

Production of Dispersion A of Resin Particles

A 5 L stainless steel pot was charged with 800 g of the polyester A, 525 g of the polyester B and 250 g of the master batch A (the mixed resin obtained by mixing and melting the polyester A, the polyester B and the master batch A at such a mixing ratio had a softening point of 114° C. and a glass transition point of 64° C.), 100 g of an anionic surfactant "NEOPELEX G-15" (sodium dodecylbenzenesulfonate; solid content: 15% by weight) available from Kao Corporation, 15 g of a nonionic surfactant "EMULGEN 430" (polyoxyethylene (26 mol) oleyl ether; HLB: 16.2) available from Kao Corporation and 689 g of a 5 wt % potassium hydroxide aqueous solution, and the contents of the pot were dispersed at 25° C. while stirring with a paddle-shaped stirrer at a rate of 200 r/min. Then, the contents of the pot were stabilized at 95° C., and held for 2 h while stirring with a paddle-shaped stirrer at a rate of 200 r/min. Successively, while stirring with a paddle-shaped stirrer at a rate of 200 r/min, 2845 g in total of deionized water was dropped into the pot at a rate of 15 g/min. The temperature of the reaction system was maintained at 95° C. during dropping the deionized water. After cooling, the obtained reaction mixture was passed through a wire mesh having a 150 mesh screen (opening: 105 μm) to obtain a dispersion A containing resin particles dispersed therein. The resin particles contained in the thus obtained dispersion A had a volume median particle size (D50) of 0.15 μm and a solid content of 31% by weight. No residual resin components remained on the wire mesh.

Production Example 6

Production of Dispersion B of Resin Particles

A 5 L stainless steel pot was charged with 299 g of the polyester A, 210 g of the polyester B and 130 g of the master batch A (the mixed resin obtained by mixing and melting the polyester A, the polyester B and the master batch A at such a mixing ratio had a softening point of 114° C. and a glass transition point of 64° C.), 40 g of an anionic surfactant "NEOPELEX G-15" (sodium dodecylbenzenesulfonate; solid content: 15% by weight) available from Kao Corporation, 6 g of a nonionic surfactant "EMULGEN 430" (polyoxyethylene (26 mol) oleyl ether; HLB: 16.2) available from Kao Corporation and 274 g of a 5 wt % potassium hydroxide aqueous solution, and the contents of the pot were dispersed at 25° C. while stirring with a paddle-shaped stirrer at a rate of 200 r/min. Then the contents of the pot were stabilized at 95° C., and held for 2 h while stirring with a paddle-shaped stirrer at a rate of 200 r/min. Successively, while stirring with a paddle-shaped stirrer at a rate of 200 r/min, 1135 g in total of deionized water was dropped into the pot at a rate of 6 g/min. The temperature of the reaction system was maintained at 95° C. during dropping the deionized water. After cooling, the obtained reaction mixture was passed through a wire mesh having a 150 mesh screen (opening: 105 μm) to obtain a dispersion B containing resin particles dispersed therein. The resin particles contained in the resultant dispersion B had a volume median particle size (D50) of 0.15 μm and a solid content of 32% by weight. No residual resin components remained on the wire mesh.

Production Example 7

Production of Dispersion C of Composite Fine Particles

A 5 L stainless steel pot was charged with 725 g of the polyester A, 525 g of the polyester B, 250 g of the master batch A and 82.5 g of the master batch B (the mixed resin obtained by mixing and melting the polyester A, the polyester B, the master batch A and the master batch B at such a mixing ratio had a softening point of 114° C. and a glass transition point of 64° C.), 10 g of an anionic surfactant "NEOPELEX G-15" (sodium dodecylbenzenesulfonate; solid content: 15% by weight) available from Kao Corporation, 15 g of a nonionic surfactant "EMULGEN 430" (polyoxyethylene (26 mol) oleyl ether; HLB: 16.2) available from Kao Corporation and 689 g of a 5 wt % potassium hydroxide aqueous solution, and the contents of the pot were dispersed at 25° C. in while stirring with a paddle-shaped stirrer at a rate of 200 r/min. Then the contents of the pot were stabilized at 95° C., and held for 2 h while stirring with a paddle-shaped stirrer at a rate of 200 r/min. Successively, while stirring with a paddle-shaped stirrer at a rate of 200 r/min, 2845 g in total of deionized water was dropped into the pot at a rate of 15 g/min. The temperature of the reaction system was maintained at 95° C. during dropping the deionized water. After cooling, the obtained reaction mixture was passed through a wire mesh having a 150 mesh screen (opening: 105 μm) to obtain a dispersion C. The composite fine particles contained in the resultant dispersion C had a volume median particle size (D50) of 0.18 μm and a solid content of 32% by weight. No residual resin components remained on the wire mesh.

PRODUCTION EXAMPLE 8

Production of Dispersion D of Composite Fine Particles

A 5 L stainless steel pot was charged with 330 g of the polyester A, 210 g of the polyester B and 66 g of the master batch B (the mixed resin obtained by mixing and melting the polyester A, the polyester B and the master batch B at such a mixing ratio had a softening point of 114° C. and a glass transition point of 64° C.), 40 g of an anionic surfactant "NEOPELEX G-15" (sodium dodecylbenzenesulfonate; solid content: 15% by weight) available from Kao Corporation, 6 g of a nonionic surfactant "EMULGEN 430" (polyoxyethylene (26 mol) oleyl ether; HLB: 16.2) available from Kao Corporation and 279 g of a 5 wt % potassium hydroxide aqueous solution, and the contents of the pot were dispersed at 25° C. while stirring with a paddle-shaped stirrer at a rate of 200 r/min. Then the contents of the pot were stabilized at 95° C., and held for 2 h while stirring with a paddle-shaped stirrer at a rate of 200 r/min. Successively, while stirring with a paddle-shaped stirrer at a rate of 200 r/min, 1135 g in total of deionized water was dropped into the pot at a rate of 6 g/min. The temperature of the reaction system was maintained at 95° C. during dropping the deionized water. After cooling, the obtained reaction mixture was passed through a wire mesh having a 150 mesh screen (opening: 105 μm) to obtain a dispersion D of composite fine particles. The composite fine particles contained in the resultant dispersion D had a volume median particle size (D50) of 0.16 μm and a solid content of 31% by weight. No residual resin components remained on the wire mesh.

Production Example 9

Production of Dispersion E of Fine Particles of Charge Control Agent

A 2 L beaker was charged with 331 g of a water slurry product of a charge control agent "BONTRON E-84" available from Orient Chemical Industry Co., Ltd., 273 g of deionized water, and 170 g of an anionic surfactant "NEOPELEX G-65" available from Kao Corporation, and the content of the beaker were mixed with each other using a "Homomixer" available from Tokushu Kika Kogyo Co., Ltd., at 5000 rpm for 5 min. The resultant mixed solution was dispersed ten times each under 150 MPa using a dispersing device "MICROFLUIDIZER M-140K" available from Microfluidics Corp., thereby obtaining a dispersion E of the charge control agent. The "fine particles of the charge control agent" contained in the resultant dispersion E had a volume median particle size (D50) of 0.46 μm, a CV value of 53 and a solid content of 25.5% by weight.

Production Example 10

Production of Dispersion F of Fine Particles of Releasing Agent

After 3.57 g of an aqueous solution of dipotassium alkenyl succinate "LATEMUL ASK" (concentration of effective ingredients: 28%) available from Kao Corp., was dissolved in 400 g of deionized water in a 1 L beaker, 100 g of a carnauba wax (melting point: 85° C.) available from Kato Yokoh Co., Ltd., was dispersed in the resultant solution. While maintaining the obtained dispersion at a temperature of 90 to 95° C., the dispersion was subjected to dispersing treatment for 30 min by using "Ultrasonic Homogenizer 600W" available from Nippon Seiki Co., Ltd., thereby obtaining a dispersion F. The fine particles of the releasing agent contained in the resultant dispersion F had a volume median particle size (D50) of 0.47 μm, a CV value of 26 and a solid content of 22% by weight.

Example 1

Production of Cyan Toner 1

[Step (A): Step of Aggregating Resin Particles Contained in a Dispersion of the Resin Particles to Obtain Core (Aggregated) Particles]

A 2 L four-necked flask equipped with a dehydration tube, a stirrer and a thermocouple was charged with 200 g of the dispersion B of the resin particles, 15 g of the dispersion F of fine particles of the releasing agent and 55 g of deionized water, and the contents of the flask were mixed with each other at room temperature. Then, while stirring the dispersion with a paddle-shaped stirrer, an aqueous solution prepared by dissolving 14 g of ammonium sulfate (guaranteed reagent available from Sigma Aldrich Japan Co., Ltd.) in 112 g of deionized water was dropped into the mixture at room temperature over 10 min. Thereafter, the resultant mixed dispersion was heated to 54° C. to form aggregated particles. The obtained dispersion was held at 54° C. for 3 h. As a result, it was confirmed that the obtained core (aggregated) particles had a volume median particle size (D50) of 3.8 μm, and the solid content in the resultant dispersion was 17% by weight.

[Step (B): Step of Allowing the Composite Fine Particles to Adhere Onto the Core (Aggregated) Particles Obtained in the Step (A) to Obtain "Composite Fine Particle-Adhering Core Particles"]

A mixture composed of 20 g of the dispersion D of composite fine particles and 6 g of deionized water was dropped to the core (aggregated) particles obtained in the step (A) over 25 min at a rate of 1 g/min (i.e., at such a rate that the amount of the resin component forming the composite fine particles was 0.4 part by weight/min on the basis of 100 parts by weight of the resin forming the aggregated particles). Thereafter, the resultant dispersion was held at 54° C. for 20 min. After repeating the above procedure two times, a mixture composed of 20 g of the dispersion D and 6 g of deionized water, and an aqueous solution prepared by dissolving 1.4 g of ammonium sulfate in 18 g of deionized water, were dropped separately but at the same time to the above dispersion over 25 min. Thereafter, the resultant dispersion was held at 54° C. for 20 min. After repeating the above procedure once more, an aqueous solution prepared by diluting 17 g of a sodium polyoxyethylene (2 mol) dodecylethersulfate aqueous solution (solid content: 28% by weight) with 150 g of deionized water was added to the resultant dispersion to obtain "composite fine particle-adhering core particles" (charge control agent-adhering aggregated particles). At this time, the thus obtained "composite fine particle-adhering core particles" had a volume median particle size (D50) of 5.1 μm and a CV value of 26.

[Step (C): Step of Heating the "Composite Fine Particle-Adhering Core Particles" Obtained in the Step (B) to Obtain Coalesced Particles]

The "composite fine particle-adhering core particles" obtained in the step (B) were heated to 77° C. and held at 77° C. for 1 h, followed by cooling the obtained particles to room temperature. During the above procedure, it was confirmed that the configuration of the toner was changed from the "composite fine particle-adhering core particles" to coalesced particles. The thus obtained coalesced particles had a volume median particle size (D50) of 5.0 μm and a CV value of 27.

The resultant dispersion containing the coalesced particles was subjected to a suction filtration step, a washing step and a drying step to obtain toner particles in the form of colored resin fine particles. Next, a hydrophobic silica ("CABOSEAL TS720" commercially available from Cabot Corp) was externally added to the colored resin fine particles in an amount of 1.0 part by weight on the basis of 100 parts by weight of the colored resin fine particles by using a Henschel mixer to obtain a cyan toner 1. The thus obtained cyan toner 1 had a volume median particle size (D50) of 4.8 μm and a CV value of 26.

Example 2

Production of Cyan Toner 2

The same procedure as in Example 1 was repeated except for using the dispersion A of resin particles and the dispersion C of composite fine particles in place of the dispersion B of resin particles and the dispersion D of composite fine particles, respectively, thereby obtaining a cyan toner 2. The thus obtained cyan toner 2 had a volume median particle size (D50) of 4.6 μm and a CV value of 25.

Example 3

Production of Cyan Toner 3

The same procedure as in Example 2 was repeated except for using the dispersion C of composite fine particles in place of the dispersion A of resin particles used in the step (A), thereby obtaining a cyan toner 3. The thus obtained cyan toner 3 had a volume median particle size (D50) of 4.6 μm and a CV value of 24.

Example 4

Production of Cyan Toner 6

The same procedure as in Example 2 was repeated except for using a mixture of 20 g of the dispersion A of resin particles and 0.12 g of the dispersion E of "fine particles of the charge control agent" in place of the dispersion C of composite fine particles used in the step (B), thereby obtaining a cyan toner 6. The thus obtained cyan toner 6 had a volume median particle size (D50) of 5.0 μm and a CV value of 24.

Comparative Example 1

Production of Cyan Toner 4

The same procedure as in Example 2 was repeated except for using the dispersion A of resin particles in place of the dispersion C of composite fine particles used in the step (B), thereby obtaining a cyan toner 4. The thus obtained cyan toner 4 had a volume median particle size (D50) of 5.2 μm and a CV value of 23.

Comparative Example 2

Production of Cyan Toner 5

The same procedure as in Example 3 was repeated except for using the dispersion A of resin particles in place of the dispersion C of composite fine particles used in the step (B), thereby obtaining a cyan toner 5. The thus obtained cyan toner 5 had a volume median particle size (D50) of 5.4 μm and a CV value of 24.

The particle sizes and CV values of the core (aggregated particles), the "composite fine particle-adhering core particles", the coalesced particles and the toners respectively obtained in Examples 1 to 4 and Comparative Examples 1 and 2 are shown in Table 1.

In addition, the thus obtained toners were respectively subjected to the following evaluation for printability. The results are shown in Table 1.

[Occurrence of Fogging on Photoconductor]

The toner was loaded to a non-magnetic one-component type developing device "MICROLINE 5400" available from Oki Data Co., Ltd., to print an unfixed toner image at a standard developing bias voltage. After printing, fogging caused on a photoconductor was sampled on a mending tape to measure a difference (ΔE) in whiteness between the fogging and a blank. The degree of occurrence of fogging on the photoconductor was evaluated according to the following evaluation criteria. The results are shown in Table 1.

Rank 4: ΔE was less than 0.5, and very good when practically used.

Rank 3: ΔE was not less than 0.5 and less than 0.7, and good when practically used.

Rank 2: ΔE was not less than 0.7 and less than 1.0, and still practically usable.

Rank 1: ΔE was 1.0 or more, and practically unusable.

[Occurrence of Fogging on Paper]

The toner was loaded to a non-magnetic one-component type developing device "MICROLINE 5400" available from Oki Data Co., Ltd., to print a fixed toner image at a standard developing bias voltage. After printing, a difference (ΔE) in whiteness between fogging caused on a paper and a blank was measured. The degree of occurrence of fogging on the paper was evaluated according to the following evaluation criteria. The results are shown in Table 1.

Rank 4: ΔE was less than 0.3, and very good when practically used.

Rank 3: ΔE was not less than 0.3 and less than 0.5, and good when practically used.

Rank 2: ΔE was not less than 0.5 and less than 0.7, and still practically usable.

Rank 1: ΔE was 0.7 or more, and practically unusable.

TABLE 1

| | Examples | | | | | |
|---|---|---|---|---|---|---|
| | 1 | | 2 | | 3 | |
| | Toner | | | | | |
| | 1 | | 2 | | 3 | |
| | Step (A) Dispersion | | | | | |
| Dispersion A of resin particles | | | 200 g | | | |
| Dispersion B of resin particles | 200 g | | | | | |
| Dispersion C of composite fine particles | | | | | 200 g | |
| Deionized water | 55 g | | 57 g | | 57 g | |
| Dispersion F of releasing agent | 15 g | | 15 g | | 15 g | |
| | Aqueous solution of aggregating agent | | | | | |
| Ammonium sulfate | 14 g | | 14 g | | 14 g | |
| Deionized water | 112 g | | 113 g | | 113 g | |
| Temperature (° C.) | 54 | | 47 | | 47 | |
| Retention time (hr) | 3 | | 3 | | 3 | |
| Particle size (D50) of resin particles (μm) | 3.8 | | 3.9 | | 4.7 | |
| | Step (B) | | | | | |
| Order of dropping (times *1) | 1st-3rd | 4th-5th | 1st-3rd | 4th-5th | 1st-3rd | 4th-5th |
| | Dispersion | | | | | |
| Dispersion A of resin particles | | | | | | |
| Dispersion C of composite fine particles | | | 20 g | 20 g | 20 g | 20 g |
| Dispersion D of composite fine particles | 20 g | 20 g | | | | |
| Dispersion E of charge control agent | | | | | | |
| Deionized water | 6 g | 6 g | 6 g | 6 g | 6 g | 6 g |
| | Aqueous solution of aggregating agent | | | | | |
| Ammonium sulfate | 1.4 g | | 1.4 g | | 1.4 g | |
| Deionized water | 18 g | | 18 g | | 18 g | |
| Dropping rate (g/min) | 1 | 1 | 1 | 1 | 1 | 1 |
| Retention time (hr) | 20 | 20 | 20 | 20 | 20 | 20 |
| Temperature (° C.) | 54 | 54 | 47 | 47 | 47 | 47 |
| Particle size (D50) (μm) | 5.1 | | 4.7 | | 5.3 | |
| CV value | 26 | | 28 | | 21 | |
| | Step (C) Aqueous solution of aggregation terminating agent | | | | | |
| EMULE E-27C | 17 g | | 17 g | | 17 g | |
| Deionized water | 150 g | | 151 g | | 151 g | |
| Temperature (° C.) | 77 | | 75 | | 75 | |

TABLE 1-continued

| | | | |
|---|---|---|---|
| Retention time (hr) | 1 | 1 | 1 |
| Particle size (D50) (μm) | 5.0 | 4.7 | 5.3 |
| CV value | 27 | 25 | 25 |
| Particle size of toner (μm) | 4.8 | 4.6 | 4.6 |
| CV value of toner | 26 | 25 | 24 |
| ΔE (fogging on paper) | 3 (0.41) | 4 (0.11) | 4 (0.15) |
| ΔE (fogging on photo-conductor) | 2 (0.93) | 3 (0.55) | 4 (0.42) |

| | | Comparative Examples | |
|---|---|---|---|
| | Example 4 | 1 | 2 |
| | | Toner | |
| | 6 | 4 | 5 |
| | | Step (A) Dispersion | |
| Dispersion A of resin particles | 200 g | 200 g | |
| Dispersion B of resin particles | | | |
| Dispersion C of composite fine particles | | | 200 g |
| Deionized water | 57 g | 58 g | 57 g |
| Dispersion F of releasing agent | 15 g | 15 g | 15 g |
| | | Aqueous solution of aggregating agent | |
| Ammonium sulfate | 14 g | 14 g | 14 g |
| Deionized water | 113 g | 113 g | 113 g |
| Temperature (° C.) | 47 | 55 | 49 |
| Retention time (hr) | 3 | 3 | 3 |
| Particle size (D50) of resin particles (μm) | 4.0 | 3.5 | 5.0 |

| | | | | | | |
|---|---|---|---|---|---|---|
| | | | Step (B) | | | |
| Order of dropping (times *1) | 1st-3rd | 4th-5th | 1st-3rd | 4th-5th | 1st-3rd | 4th-5th |
| | | | Dispersion | | | |
| Dispersion A of resin particles | 20 g | 20 g | 20 g | 20 g | 20 g | 20 g |
| Dispersion C of composite fine particles | | | | | | |
| Dispersion D of composite fine particles | | | | | | |
| Dispersion E of charge control agent | 0.12 g | 0.12 g | | | | |
| Deionized water | 6 g | 6 g | 6 g | 6 g | 6 g | 6 g |
| | | | Aqueous solution of aggregating agent | | | |
| Ammonium sulfate | | 1.4 g | | 1.4 g | | 1.4 g |
| Deionized water | | 18 g | | 18 g | | 18 g |
| Dropping rate (g/min) | 1 | 1 | 1 | 1 | 1 | 1 |

TABLE 1-continued

| | | | | | | |
|---|---|---|---|---|---|---|
| Retention time (hr) | 20 | 20 | 20 | 20 | 20 | 20 |
| Temperature (° C.) | 47 | 47 | 55 | 55 | 49 | 49 |
| Particle size (D50) (μm) | 5.2 | | 4.9 | | 5.7 | |
| CV value | 27 | | 24 | | 23 | |
| | | | Step (C) | | | |
| | | | Aqueous solution of aggregation terminating agent | | | |
| EMULE E-27C | 17 g | | 17 g | | 17 g | |
| Deionized water | 151 g | | 151 g | | 151 g | |
| Temperature (° C.) | 75 | | 80 | | 77 | |
| Retention time (hr) | 1 | | 1 | | 1 | |
| Particle size (D50) (μm) | 5.1 | | 4.8 | | 5.6 | |
| CV value | 25 | | 23 | | 24 | |
| Particle size of toner (μm) | 5.0 | | 5.2 | | 5.4 | |
| CV value of toner | 24 | | 23 | | 24 | |
| ΔE (fogging on paper) | 3 (0.44) | | 1 (0.75) | | 3 (0.44) | |
| ΔE (fogging on photo-conductor) | 3 (0.62) | | 1 (1.85) | | 1 (1.25) | |

Note

*1: The order of dropping in the step (B) (times): In any of Examples and Comparative Examples, the dispersion shown in the "Step (B)" in Table 1 was dropped five times in total; in the 1st to 3rd dropping times, only the dispersion was dropped, and in the 4th and 5th dropping times, the dispersion was dropped together with the aqueous solution of aggregating agent.

From the above results, since all of the toners obtained in Examples 1 to 4 exhibited a less occurrence of fogging on both the photoconductor and the paper, it was confirmed that these toners were able to realize formation of high-quality images. On the other hand, in Comparative Example 1 where no charge control agent was contained in the toner and Comparative Example 2 where the charge control agent was added only in the step (A), much fogging occurred on the photoconductor and the paper, resulting in deteriorated quality of the resultant toner images. It is considered that the fogging was caused by the following reasons. That is, in Comparative Examples 1 and 2, since the charge control agent was not present in the vicinity of the surface of the toner and the toner had a spherical shape, the toner itself was inhibited from forming a charge-generating portion thereon and, therefore, failed to be sufficiently charged.

What is claimed is:

1. A process for producing a toner for electrophotography, comprising:

(A1) forming a resin particle dispersion by emulsifying a first polyester-containing resin and phase inverting;

(A2) aggregating resin particles contained in said dispersion to obtain an aggregated particles as core particles dispersion (1);

(B1) melt-kneading a charge control agent and a second polyester-containing resin to form a melt-kneaded material, cooling and then coarsely pulverizing the material, and dispersing in an aqueous medium to obtain a composite fine particles dispersion (2) comprising composite fine particles, (B2) adding said composite fine particles dispersion (2) to said aggregated particles as core particles dispersion (1) to allow said composite fine particles to adhere onto said aggregated particles, thereby obtaining composite fine particle-adhering core particles; and (C) heating said composite fine particle-adhering core particles to obtain coalesced particles.

2. The process according to claim 1, wherein said composite fine particles have a volume median particle size (D50) of from 0.05 to 2 μm.

3. The process according to claim 1, wherein a content of said charge control agent in said composite fine particles is from 0.01 to 10 parts by weight on the basis of 100 parts by weight of a resin contained in said composite fine particles.

4. The process according to claim 1, wherein an amount of a resin forming said composite fine particles is from 5 to 100 parts by weight on the basis of 100 parts by weight of a resin forming said core particles.

5. The process according to claim 1, wherein said heating of the step (C) is conducted at a temperature not lower than a glass transition point of a resin forming said composite fine particles and not higher than a temperature calculated from a softening point of the resin+(plus) 20° C.

6. The process according to claim 1 wherein said first and second polyester-containing resins have a polyester content of 60% by weight or more.

7. The process according to claim 1 wherein said first and second polyester-containing resins have a polyester content of 80% by weight or more.

8. The process according to claim 1 wherein said first and second polyester-containing resins have a polyester content of substantially 100% by weight.

9. The process according to claim 1 wherein said first polyester-containing resin has a softening point of 70 to 165° C.

10. The process according to claim 1 wherein said first polyester-containing resin has an acid value of from 6 to 35 mg KOH/g.

11. The process according to claim 1 wherein said first polyester-containing resin has a number-average molecular weight of from 1,000 to 10,000.

12. The process according to claim 1 wherein said charge control agent is a salicylic acid metal salt.

13. The process according to claim 1, wherein said resin particles comprise a colorant.

14. The process according to claim 1, wherein step (A1) comprises neutralizing said first polyester-containing resin after emulsifying, at a temperature not lower than a glass transition point of said first polyester-containing resin and phase inverting by adding an aqueous medium at a temperature not lower than a glass transition point of said first polyester-containing resin.

15. The process according to claim 1, wherein said phase inverting is performed by adding 100 to 2,000 pbw of an aqueous medium, based on 100 pbw of said first polyester-containing resin, to a dispersion of said first polyester-containing resin particles.

16. The process according to claim 1 wherein said first polyester-containing resin has a glass transition temperature of 50 to 85° C.

17. The process according to claim 1 wherein said first and second polyester-containing resins are produced from the same monomers.

* * * * *